US011845265B2

(12) United States Patent
Ito et al.

(10) Patent No.: US 11,845,265 B2
(45) Date of Patent: Dec. 19, 2023

(54) RECORDING DEVICE

(71) Applicant: Seiko Epson Corporation, Tokyo (JP)

(72) Inventors: Shun Ito, Matsumoto (JP); Atsuhiko Takeuchi, Matsumoto (JP); Masaki Namiki, Kitakyushu (JP); Haruna Takahashi, Ina (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 17/646,223

(22) Filed: Dec. 28, 2021

(65) Prior Publication Data

US 2022/0203712 A1 Jun. 30, 2022

(30) Foreign Application Priority Data

Dec. 28, 2020 (JP) ..... 2020-218698

(51) Int. Cl.
*B41J 11/00* (2006.01)

(52) U.S. Cl.
CPC ..... *B41J 11/0085* (2013.01)

(58) Field of Classification Search
CPC ..... B41J 11/0085; B41J 11/0065; B41J 11/06; B41J 11/08
See application file for complete search history.

(56) References Cited

U.S. PATENT DOCUMENTS 10,857,817 B2 * 12/2020 Furuya ..... B65H 5/38
2013/0002749 A1 * 1/2013 Masuda ..... B41J 11/06 347/16
2013/0027491 A1 * 1/2013 Koike ..... B41J 11/20 347/104
2016/0039222 A1 * 2/2016 Kamijo ..... B41J 11/0085 347/104
2018/0118495 A1 * 5/2018 Dekel ..... B41J 11/06

FOREIGN PATENT DOCUMENTS

JP 2013-022897 2/2013

OTHER PUBLICATIONS

Konuma, Kyoei, Printer and Platen, Dec. 28, 2016, Japan, All (Year: 2016).*

* cited by examiner

*Primary Examiner* — Justin Seo
*Assistant Examiner* — Tracey M McMillion
(74) *Attorney, Agent, or Firm* — WORKMAN NYDEGGER

(57) ABSTRACT

A printer includes a recording unit, a support portion, a negative pressure chamber, a first sectioned chamber, a second sectioned chamber, a first suction port, and a second suction port. The support portion includes a support face configured to support roller paper. The negative pressure chamber is disposed at an opposite side of the support portion from the recording unit side. The first and the second sectioned chamber include a first and a second bottom surface. The first and the second suction port cause an outside space and the negative pressure chamber to communicate with each other. An opening area of the second suction port is smaller than an opening area of a first suction portion. The second suction port disposed most upstream in the first sectioned chamber is disposed upstream, in the transport direction, of the first suction port disposed most upstream in the second sectioned chamber.

14 Claims, 7 Drawing Sheets

RECORDING DEVICE

The present application is based on, and claims priority from JP Application Serial Number 2020-218698 filed on Dec. 28, 2020, the disclosure of which is hereby incorporated by reference herein in its entirety.

BACKGROUND

1. Technical Field

The present disclosure relates to a recording device.

2. Related Art

A liquid jetting device described in JP-A-2013-22897 includes a suction device and a platen including a plurality of groove portions arranged in the width direction of a medium. The plurality of groove portions each include a hole used to suck a medium.

When sucking is performed at the central portion of the medium in the width direction as in the liquid jetting device in JP-A-2013-22897, there is a possibility that the negative pressure in the negative pressure chamber is not enough at an end portion of the medium in the width direction.

SUMMARY

In order to solve the problem described above, a recording device according to the present disclosure includes a recording unit configure to perform recording on a recording medium transported in a transport direction, a support portion disposed facing the recording unit and including a support face configured to support the recording medium, a negative pressure chamber disposed at an opposite side of the support portion from a side of the recording unit, a plurality of sectioned chambers formed at the support portion and including a bottom surface recessed from the support face, the sectioned chambers being disposed in a width direction intersecting the transport direction, and a plurality of suction ports formed at the support portion and configured to cause the negative pressure chamber and a space outside of the support face to communicate with each other, in which the plurality of sectioned chambers include at least one first sectioned chamber configured to face the recording medium at a position inside an end portion of the recording medium in the width direction and closest to the end portion, and at least one second sectioned chamber disposed inside the first sectioned chamber in the width direction, the plurality of suction ports include at least one first suction port and at least one second suction port having a second opening area smaller than a first opening area of the first suction port, and the second suction port disposed most upstream in the transport direction in the first sectioned chamber is disposed upstream, in the transport direction, of the first suction port disposed most upstream in the transport direction in the second sectioned chamber.

DESCRIPTION OF EXEMPLARY EMBODIMENTS

Figure 1:
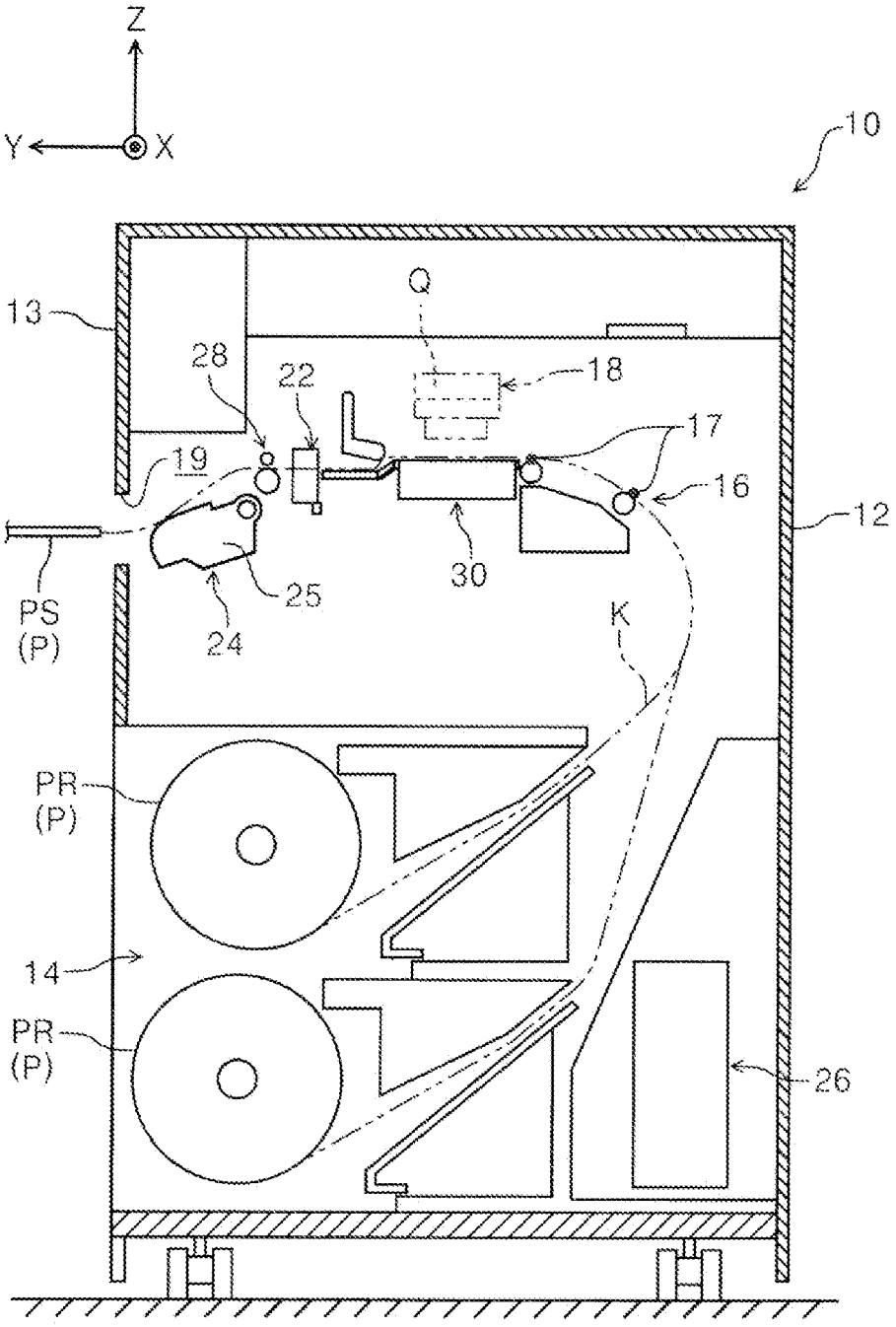
FIG. 1 is an entire configuration diagram illustrating a printer according to an embodiment.
Figure 2:
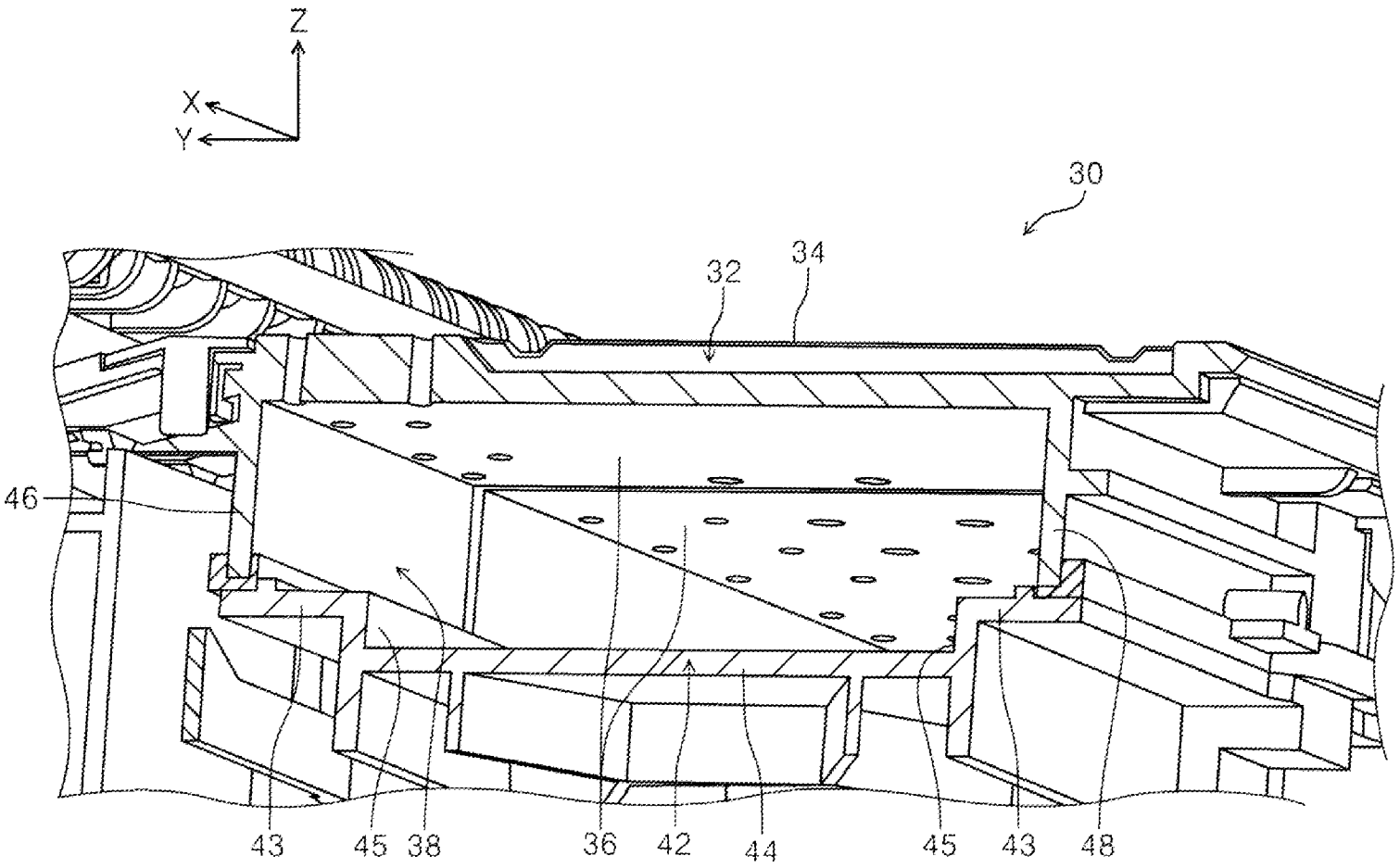
FIG. 2 is a perspective view illustrating an upper portion of the inside of a platen unit of the printer according to the embodiment.

A recording device according to a first to fourteenth aspects of the present disclosure will be schematically described below.

A recording device according to a first aspect of the present disclosure provided to solve the problem described above includes: a recording unit configure to perform recording on a recording medium transported in a transport direction; a support portion disposed facing the recording unit and including a support face configured to support the recording medium; a negative pressure chamber disposed at an opposite side of the support portion from a side of the recording unit; a plurality of sectioned chambers formed at the support portion and including a bottom surface recessed from the support face, the sectioned chambers being disposed in a width direction intersecting the transport direction; and a plurality of suction ports formed at the support portion and configured to cause the negative pressure chamber and a space outside of the support face to communicate with each other, in which the plurality of sectioned chambers include: at least one first sectioned chamber configured to face the recording medium at a position inside an end portion of the recording medium in the width direction and closest to the end portion; and at least one second sectioned chamber disposed inside the first sectioned chamber in the width direction, the plurality of suction ports include at least one first suction port and at least one second suction port having a second opening area smaller than a first opening area of the first suction port, and the second suction port disposed most upstream in the transport direction in the first sectioned chamber is disposed upstream, in the transport direction, of the first suction port disposed most upstream in the transport direction in the second sectioned chamber.

With the present aspect, the air outside of the support portion passes through the at least one first suction port and the at least one second suction port and flows into the negative pressure chamber. The recording medium is transported while being pulled toward the support portion due to this flow of air.

Here, the second suction port in the first sectioned chamber is disposed upstream of the first suction port in the second sectioned chamber. Thus, even if the negative pressure in the negative pressure chamber is not enough at an end portion of the support portion in the width direction, suction at the end portion starts earlier than that at the central portion of the recording medium in the width direction. This makes it possible to suppress a deficiency of suction at the end portion of the recording medium in the width direction.

In addition, the opening area of the second suction port disposed upstream of the first suction port is smaller than the opening area of the first suction port. Thus, the velocity of air flow that enters the second suction port is higher than the velocity of air flow that enters the first suction port. This makes it possible to further suppress a deficiency of suction at the end portion of the recording medium in the width direction.

In the first aspect, the recording device according to a second aspect is configured such that the number of second suction ports is greater than the number of the first suction ports.

With the present aspect, the number of sucked portions at the end portion of the recording medium in the width direction is greater than that at the central portion. This makes it possible to suppress lifting of the end portion of the recording medium in the width direction at the support portion.

In the first or second aspect, the recording device according to a third aspect is configured such that the bottom surface includes at least one pillar portion that stands upright from the bottom surface, the height of an upper surface of the pillar portion in an upright direction is lower than the height of the support face in the upright direction, and the plurality of suction ports include are through holes that extend through the pillar portion in the upright direction.

With the present aspect, the plurality of suction ports are each formed so as to have a tubular shape extending in the upright direction. This makes the frequency of the generated sound reduced as compared with a configuration in which the plurality of suction ports are formed at the support face, which makes a so-called whistling effect less likely to occur and makes it possible to suppress noise. Furthermore, since the height of the upper surface is lower than the height of the support face, it is possible to prevent a portion of the recording medium that is supported by the support face from being suctioned at the upper surface of the pillar portion.

In any one of the first to third aspects, the recording device according to a fourth aspect is configured such that the bottom surface includes at least one rib extending in the transport direction and provided at a position differing from the suction ports in the transport direction.

With the present aspect, the recording medium is supported by being brought into contact with the rib before being brought into contact with the bottom surface. This makes it possible to prevent a portion of the transported recording medium from sagging to the bottom surface.

In the fourth aspect, the recording device according to a fifth aspect is configured such that the centers of the suction ports in the width direction and the center of the rib in the width direction are disposed side by side in the transport direction.

With the present aspect, when a portion of the recording medium is sucked with the suction ports, the rib supports the recording medium upstream or downstream of the suction ports in the transport direction. Thus, it is possible to prevent a portion of the transported recording medium from sagging to the bottom surface.

In the fourth or fifth aspect, the recording device according to a sixth aspect is configured such that the height of at least a portion of a top portion of the rib is aligned with the height of the support face.

With the present aspect, a portion of the recording medium that is opposed to the sectioned chamber is supported by the rib, as with a portion supported by the support face. Thus, it is possible to prevent the recording medium from falling into the sectioned chamber.

In any one of the fourth to sixth aspects, the recording device according to a seventh aspect is configured such that an end portion, at an upstream side in the transport direction, of the rib includes a sloped surface that rises toward a downstream side.

With the present aspect, even if a portion of the recording medium falls toward the bottom surface of the sectioned chamber, the portion of the recording medium is brought into contact with the sloped surface and is guided, so that the position in height of the recording medium rises. Thus, it is possible to prevent the portion of the recording medium from being caught on the rib.

In any one of the fourth to seventh aspects, the recording device according to an eighth aspect is configured such that wall portions of the suction ports and the rib are integrally formed.

With the present aspect, when external force acts on the wall portion of each of the suction ports, the rib supports the wall portion, which makes it possible to enhance the strength of the wall portion of the suction port.

In the eighth aspect, the recording device according to a ninth aspect is configured such that the support portion includes an inner wall surface that constitutes a portion of a wall surface of the negative pressure chamber, and in the support portion, the support face, the wall portions of the suction ports, and the inner wall surface corresponding to a position where the rib is formed include a flat surface.

With the present aspect, a portion of the inner wall surface of the negative pressure chamber includes a flat surface. Thus, as compared with a configuration in which a protruding portion is formed at the inner wall surface, a pressure loss at the negative pressure chamber reduces. Thus, it is possible to suppress a reduction in suction force at the suction port.

In addition, in the support portion, a portion disposed at an opposite side from the flat surface is a protruding portion that protrudes from the bottom surface. Thus, it is possible to easily mold the support portion.

In any one of the first to ninth aspects, the recording device according to a tenth aspect is configured such that the recording unit discharges a droplet on the recording medium to perform recording, a droplet receiving portion configured to receive the droplet when borderless recording is performed on the recording medium is provided at a portion of the support face that corresponds to an end portion of the recording medium in the width direction, and the first sectioned chamber is adjacent to the droplet receiving portion in the width direction.

In the tenth aspect, the recording device according to an eleventh aspect is configured such that, in the support face, the droplet receiving portion is provided at a reference position where one end of the recording medium in the width direction is disposed.

With the present aspect, at the reference position, one end of the recording medium in the width direction is pulled toward the support portion. Thus, even if the size of the recording medium changes, it is possible to cause the support portion to support the one end of the recording medium in the width direction.

In the eleventh aspect, the recording device according to a twelfth aspect is configured such that the recording unit is configured to perform recording on the recording medium having a plurality of sizes with different widths in the width direction, and a plurality of the droplet receiving portions are provided at a position other than the reference position so as to be aligned with a position of an end portion of the recording medium at another side in the width direction.

With the present aspect, even if the size of the recording medium is changed, it is possible to support both end portions of the recording medium in the width direction.

In any one of the first to twelfth aspects, the recording device according to a thirteenth aspect is configured such that an emission portion configured to emit air in the negative pressure chamber is provided at an end portion of the negative pressure chamber at one side in the width direction.

With the present aspect, the emission portion is provided at one side of the negative pressure chamber in the width direction. Thus, when the recording medium having a small size is transported in an unbalanced manner toward one side in the width direction, it is possible to efficiently suck the end portion of the recording medium having a small size.

In the thirteenth aspect, the recording device according to a fourteenth aspect is configured such that a movable wall is provided closer to another side of the negative pressure chamber in the width direction than the emission portion, the movable wall being configured to section the negative pressure chamber into a first negative pressure chamber where the emission portion is provided and a second negative pressure chamber where the emission portion is not provided, the movable wall sections the negative pressure chamber into the first negative pressure chamber and the second negative pressure chamber when the width of the recording medium in the width direction is equal to or less than the width of the first negative pressure chamber in the width direction, and the movable wall releases the section between the first negative pressure chamber and the second negative pressure chamber when the width of the recording medium in the width direction is larger than the width of the first negative pressure chamber in the width direction.

With the present aspect, when the width of the recording medium in the width direction is equal to or less than the width of the first negative pressure chamber in the width direction, the negative pressure chamber is sectioned by the movable wall. This makes it possible to suppress a reduction in pressure in the first negative pressure chamber. Thus, it is possible to suppress lifting of the recording medium.

On the other hand, when the width of the recording medium in the width direction is larger than the width of the first negative pressure chamber in the width direction, the section of the negative pressure chamber by the movable wall is released. This makes it possible to suck a portion of the recording medium that corresponds to the second negative pressure chamber. Thus, even for the recording medium having a large size, it is possible to suppress lifting of an end portion of the recording medium in the width direction.

Below, one example of a recording device according to the present disclosure will be specifically described.

In each of the drawings, the X direction extending along an X-axis serves as one example of a device width direction of a printer 10 that will be described later and the width direction of the recording medium. The −X direction is a left direction as viewed from a user when the front face of the device faces the user, and the +X direction is a right direction.

The Y direction extending along a Y-axis serves as one example of a device depth direction of the printer 10. The +Y direction is a direction from the back surface of the device toward the front face, and serves as one example of a transport direction of a sheet P and roll paper PR, which will be described later, on a platen unit 30. The −Y direction is a direction from the front face of the device toward the back surface. The X direction and the Y direction extend in a horizontal direction.

The Z direction extending along a Z-axis is a device height direction of the printer 10 and a vertical direction. In addition, the +Z direction is a vertically upward direction, and the −Z direction is a vertically downward direction. The X direction, the Y direction, and the Z direction are perpendicular to each other. The sheet P serves as one example of a recording medium. In the following description, the sheet P will be discussed separately into the roll paper PR in a form of roll and cut-sheet paper PS that has been cut into a sheet shape.

FIG. 1 illustrates the printer 10 serving as one example of the recording device according to the embodiment. A not-illustrated mounting device configured to mount the cut-sheet paper PS is provided in the +Y direction relative to the printer 10.

The printer 10 includes a housing 12 having a cuboid shape. In addition, the printer 10 is configured as an inkjet-type printer that can perform printing on a sheet P having a size ranging from A4 size to A0 size, as one example. The printer 10 can perform recording on ordinary paper or a photo sheet.

Specifically, the printer 10 includes, within the housing 12, a storage portion 14, a transport unit 16, a recording unit 18, a cutting portion 22, an emission unit 24, and a platen unit 30. Note that the printer 10 includes a control unit 26 configured to control operations of each portion in the printer 10. As one example, the control unit 26 also functions as a control unit configured to control a rotary operation of a movable wall 94 (FIG. 5) that will be described later.

The housing 12 includes a side wall 13 that constitutes a wall portion at the +Y direction of the housing 12. A discharge port 19 that penetrates the Y direction is formed in the side wall 13. The discharge port 19 has a size that allows all sheets P that the printer 10 can use to pass through.

The storage portion 14 stores the roll paper PR that rotates around a central shaft extending along the X direction.

The transport unit 16 includes a plurality of transport roller pairs 17. Furthermore, along the transport path K illustrated by the long dashed double-short dashed line, the transport unit 16 transports, toward the downstream side, the roll paper PR pulled out of the storage portion 14.

The recording unit 18 records by discharging an ink Q serving as one example of the droplet onto the roll paper PR transported in the +Y direction by the transport unit 16. Note that the roll paper PR is transported in the +Y direction in a region that is opposed to the recording unit 18. In addition, the recording unit 18 is disposed in the +Z direction relative to the roll paper PR. In other words, recording is performed on the upper surface of the roll paper PR in the +Z direction.

Furthermore, the recording unit 18 can perform borderless recording on the roll paper PR. The borderless recording means recording by discharging the ink Q on the entire surface of the roll paper PR that is opposed to the recording unit 18.

The cutting portion 22 cuts the roll paper PR recorded by the recording unit 18 to form cut-sheet paper PS.

The emission unit 24 includes a holder 25 disposed downstream of the cutting portion 22 and also includes an emission roller pair 28. The holder 25 guides the cut-sheet paper PS toward the discharge port 19 while supporting the cut-sheet paper PS. The emission roller pair 28 delivers, to the holder 25, the cut-sheet paper PS that has been cut. The cut-sheet paper PS emitted from the discharge port 19 is transported to a mounting device, which is not illustrated.

Next, the platen unit 30 will be described.

As illustrated in FIGS. 1 to 5, the platen unit 30 includes, as one example, a support portion 32 extending in the X direction, a negative pressure chamber 38 disposed at an opposite side from the recording unit 18 relative to the recording unit 18, a sectioned portion 52 formed at the support portion 32, and a suction portion 84 formed at the support portion 32. In addition, the platen unit 30 includes an emission portion 92 configured to emit air in the negative pressure chamber 38.

The support portion 32 is opposed to the recording unit 18 (FIG. 1), and is disposed at a more −Z direction side than the recording unit 18. As one example, the support portion 32 has a predetermined thickness in the Z direction, and is formed into a rectangular panel shape extending in the X direction. Furthermore, the support portion 32 is made of resin, as one example. The length of the support portion 32 in the X direction is longer than the length, in the X direction, of the roll paper PR having the largest size among the roll paper PR used in the printer 10. The length of the support portion 32 in the Y direction is longer than the length of the recording unit 18 in the Y direction. The support portion 32 constitutes the upper portion of the platen unit 30 in the +Z direction. The support portion 32 includes a support face 34 serving as an end surface of the support portion 32 in the +Z direction, and an inner wall surface 36 serving as an end surface of the support portion 32 in the −Z direction.

The support face 34 includes a flat surface extending in the X-Y plane, as one example. The support face 34 supports the roll paper PR from the −Z direction. The outer shape of the support face 34 has a rectangular shape in which the dimension in the X direction is larger than the dimension in the Y direction as viewed from the +Z direction.

The inner wall surface 36 includes a flat surface extending along the X-Y plane and serving as one example of a surface that forms part of the wall surface of the negative pressure chamber 38 that will be described later. In addition, the inner wall surface 36 is a surface corresponding to positions where the support face 34, pillar portions 56 and 58, and ribs 62, 66, 78, and 79 (FIG. 4), which will be described later, are formed at the support portion 32. In other words, the inner wall surface 36 is a surface disposed at an opposite side of the support portion 32 from portions where the support face 34, the pillar portions 56 and 58, and the ribs 62, 66, 78, and 79 are formed. The outer shape of the inner wall surface 36 has a rectangular shape in which the dimension in the X direction is larger than the dimension in the Y direction as viewed from the −Z direction.

Figure 5:
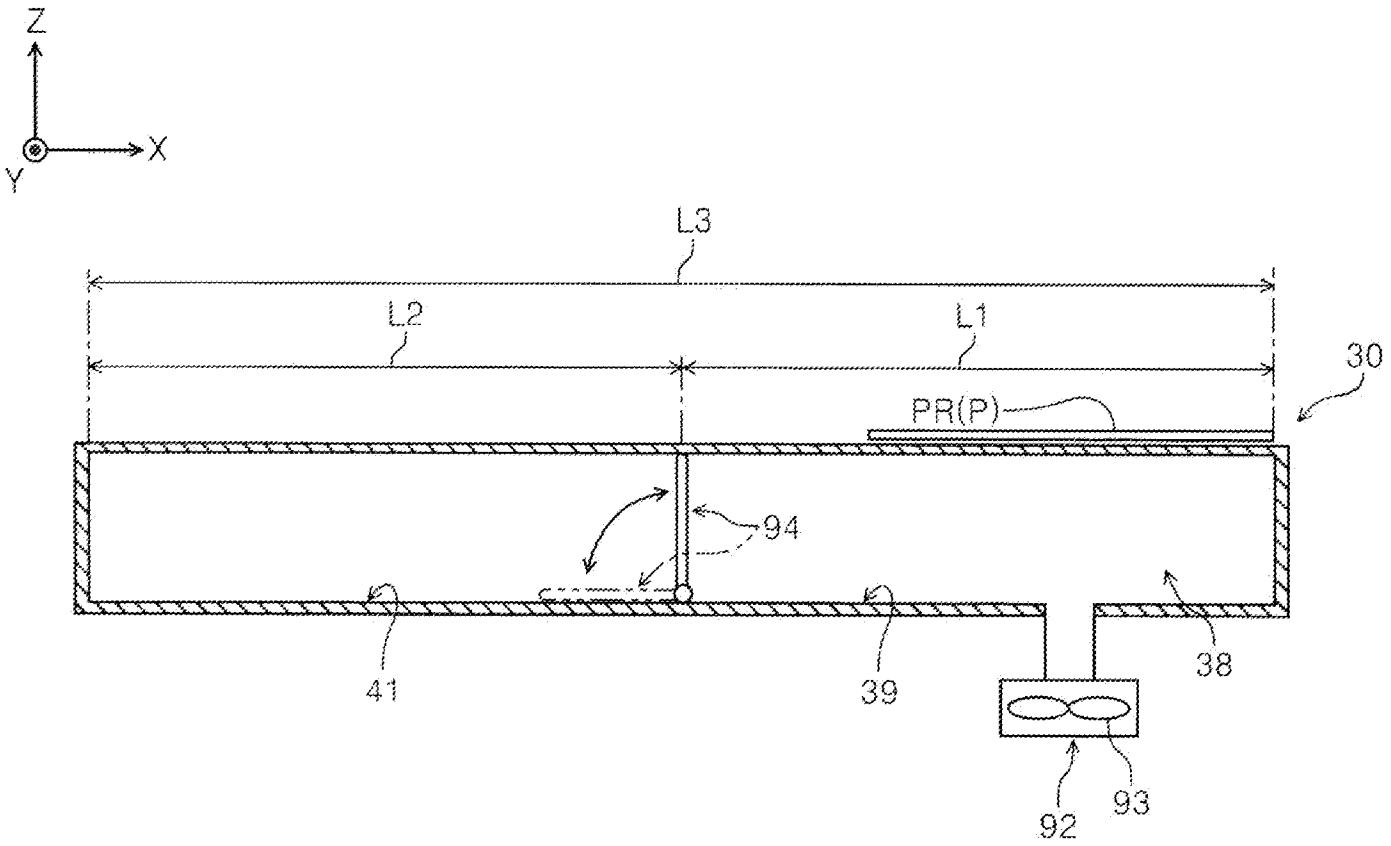
FIG. 5 is a vertical cross-sectional view illustrating an internal structure of the platen unit of the printer according to the embodiment.

As one example, the negative pressure chamber 38 is a hollow portion comprised of a bottom wall 42, a front side wall 46, a rear side wall 48, and the support portion 32, and is formed into a square tubular shape as viewed from the X direction. The ceiling surface of the negative pressure chamber 38 in the +Z direction is the inner wall surface 36. As described above, the negative pressure chamber 38 is configured to include the support portion 32, as one example. Note that the negative pressure chamber 38 is sectioned into a first negative pressure chamber 39 and a second negative pressure chamber 41 (FIG. 5). The first negative pressure chamber 39 and the second negative pressure chamber 41 will be described later.

The bottom wall 42 is disposed in the −Z direction relative to the support portion 32. The bottom wall 42 includes an upper bottom wall 43, a lower bottom wall 44 disposed in a more −Z direction than the upper bottom wall 43, and a step portion 45, as one example. The step portion 45 couples the upper bottom wall 43 and the lower bottom wall 44 in the Z direction. In other words, the central portion of the bottom wall 42 is recessed toward the −Z direction.

At an end portion of the upper bottom wall 43 in the +Y direction, the front side wall 46 stands upright in the +Z direction.

At an end portion of the upper bottom wall 43 in the −Y direction, the rear side wall 48 stands upright in the +Z direction.

Figure 3:
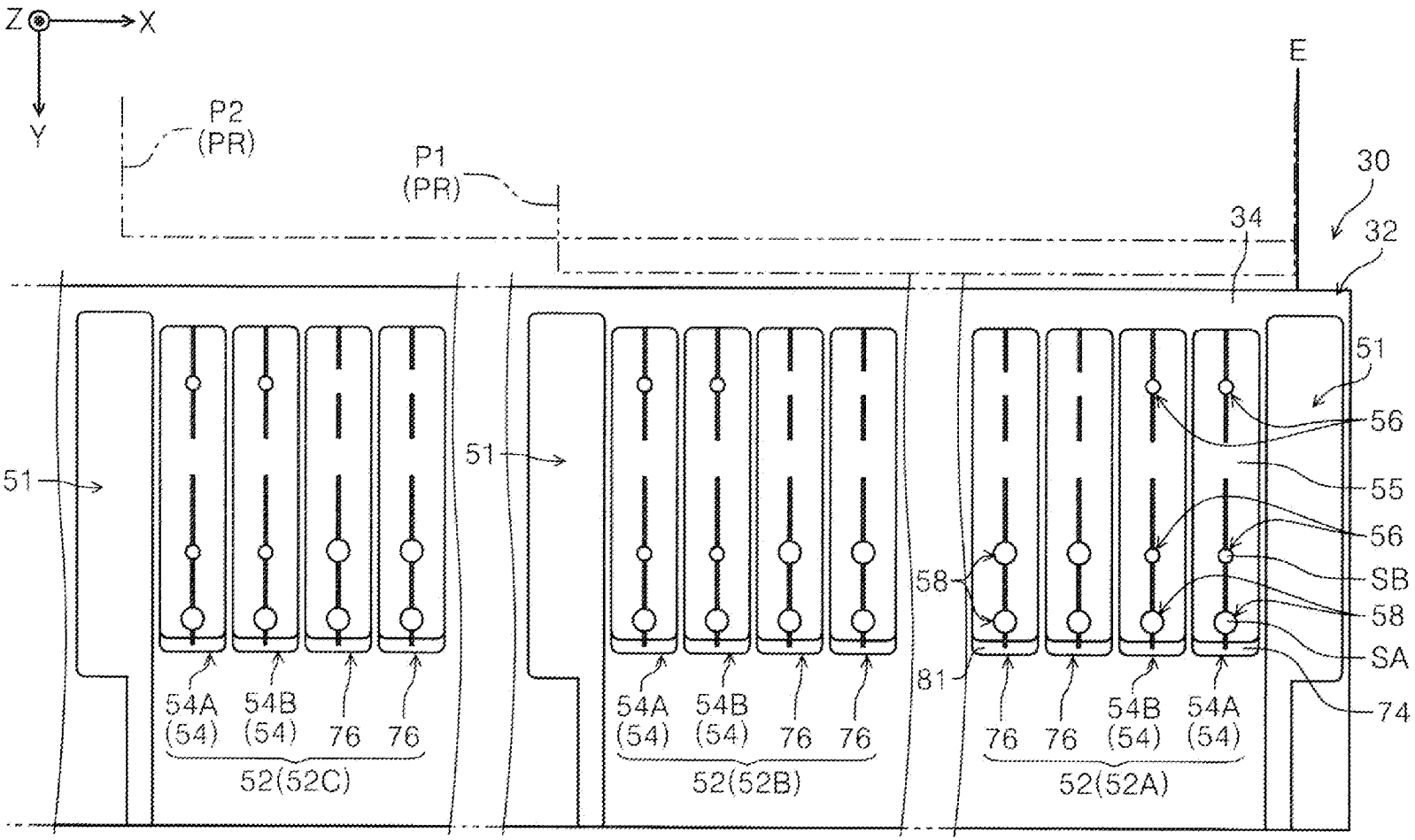
FIG. 3 is a plan view schematically illustrating a portion of a platen unit of the printer according to the embodiment.

As one example of a plurality of sectioned chambers, the sectioned portion 52 includes a first sectioned chamber 54 that is opposed to the roll paper PR in the Z direction at a position disposed inside an end portion of the roll paper PR in the X direction and closest to the end portion, and also includes a second sectioned chamber 76 disposed inside the first sectioned chamber 54 in the X direction, as illustrated in FIG. 3. Note that the first sectioned chamber 54 includes a plurality of the first sectioned chambers 54 and the second sectioned chamber 76 includes a plurality of the second sectioned chambers 76. FIG. 3 illustrates only two first sectioned chambers 54 and two second sectioned chambers 76, and does not illustrate the rest of second sectioned chambers 76.

A recessed portion 51 is provided at a portion of the support face 34 that corresponds to an end portion of the roll paper PR in the X direction. Note that FIG. 3 illustrates the recessed portion 51 at the +X direction that corresponds to an end portion of the roll paper PR at one side, and a recessed portion 51 at the −X direction that corresponds to an end portion of the roll paper PR at the other side. A plurality of recessed portions 51 are provided at an end portion in the −X direction depending on the length of the roll paper PR in the X direction. In other words, the recessed portion 51 provided at a position other than a reference position E that will be described later includes a plurality of recessed portions provided so as to be aligned with a position of an end portion of the roll paper PR at another side in the X direction.

Below, a sectioned portion 52A disposed at the end portion at one side will be described with reference to FIG. 3. The recessed portion 51 serves as one example of a droplet receiving portion, and is a portion recessed from the support face 34 toward the −Z direction. The length of the recessed portion 51 in the Y direction is longer than the length of the first sectioned chamber 54 in the Y direction, as one example. The recessed portion 51 receives an ink Q when the borderless recording described above is performed on the roll paper PR.

The roll paper PR is discussed separately such that roll paper P1 represents the roll paper having a first size and roll paper P2 represents the roll paper having a second size having a width in the X direction larger than that of the first size. Note that, in the present embodiment, at the support face 34, a position in the X direction where one end of the roll paper P1 at the +X direction is disposed and a position in the X direction where one end of the roll paper P2 at the +X direction is disposed are set to be equal. This position in the X direction is set as a reference position E. A transport method in which one end in the X direction is aligned with the reference position E regardless of the size of the roll paper PR in this manner is referred to as a side registration system.

The plurality of first sectioned chambers 54 are disposed in a state where positions of both end portions in the Y direction are arranged side by side in the X direction so as to be aligned with the X direction, as one example. One first sectioned chamber 54 among the plurality of first sectioned chambers 54 is adjacent to the recessed portion 51 in the X direction. Specifically, the first sectioned chamber 54 is disposed at the inner side in the X direction than the recessed portion 51. In addition, the recessed portion 51 is provided at a position including the reference position E in the X direction.

Of the plurality of first sectioned chambers 54, a first sectioned chamber provided at the inner side of the recessed portion 51 in the X direction is set as a first sectioned chamber 54A. In addition, a first sectioned chamber provided at a position at the inner side of the first sectioned chamber 54A in the X direction is set as a first sectioned chamber 54B, as one example. In other words, a plurality of first sectioned chambers 54 are provided at the sectioned portion 52A. In FIG. 3, one first sectioned chamber 54A and one first sectioned chamber 54B are illustrated.

The sectioned portion 52B is provided so as to be aligned with the position of an end portion of the roll paper P1 at the −X direction serving as the other side in the X direction, as one example.

The sectioned portion 52C is provided so as to be aligned with the position of an end portion of the roll paper P2 at the −X direction, as one example.

As one example, the sectioned portion 52B and the sectioned portion 52C are configured so as to be symmetric to the sectioned portion 52A with respect to a not-illustrated line extending along the Y direction.

As illustrated in FIG. 3, the first sectioned chamber 54 is formed so as to have a rectangle shape in which the dimension in the Y direction is larger than the dimension in the X direction as viewed from the +Z direction. A rounded surface is formed at four corner portions of the first sectioned chamber 54. In addition, the first sectioned chamber 54 is formed at the support portion 32, and includes a first bottom surface 55 recessed from the support face 34 toward the −Z direction.

The first bottom surface 55 serves as one example of a bottom surface. The outer shape of the first bottom surface 55 is substantially similar to the outer shape of the first sectioned chamber 54 as viewed from the +Z direction. In addition, as illustrated in FIG. 4, the first bottom surface 55 includes two pillar portions 56, one pillar portion 58, and a rib 62, 66, as one example.

Figure 4:
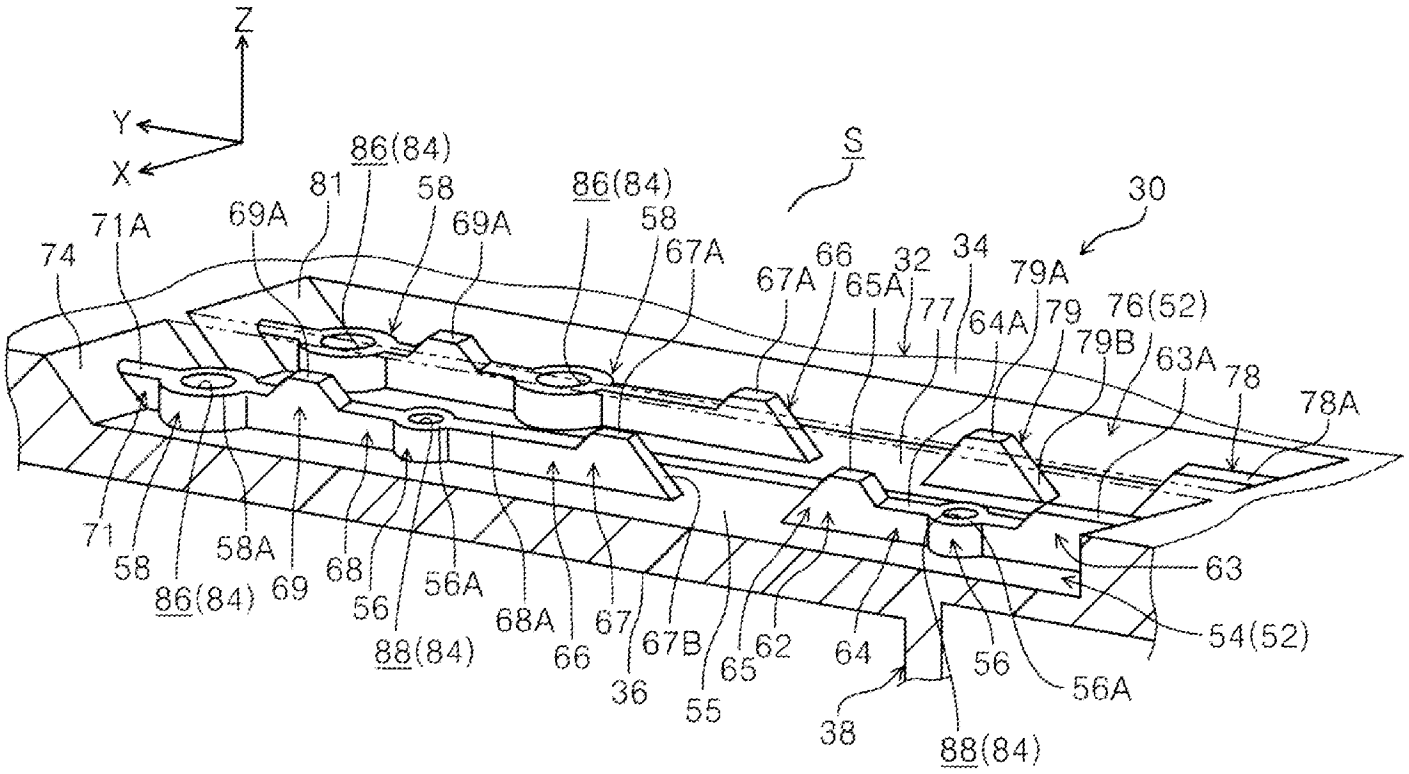
FIG. 4 is an enlarged perspective view illustrating a portion of the platen unit of the printer according to the embodiment.

As illustrated in FIG. 4, a slanting surface 74 is formed at an end portion of the first sectioned chamber 54 in the +Y direction. The slanting surface 74 is sloped so that the height in the +Z direction increases toward the +Y direction. In addition, an end portion of the slanting surface 74 in the +Y direction is coupled to the support face 34. The angle of the slanting surface 74 relative to the first bottom surface 55 is approximately 45° as one example. The slanting surface 74 guides, to the support face 34, a tip portion of the roll paper PR in the transport direction.

The two pillar portions 56 and the pillar portion 58 stand upright from the first bottom surface 55 in the +Z direction. The +Z direction serves as one example of an upright direction.

The pillar portion 56 at one side is disposed in a more −Y direction than the center of the first sectioned chamber 54 in the Y direction, in other words, disposed upstream in the Y direction. The pillar portion 56 at the other side is disposed in a more +Y direction than the center of the first sectioned chamber 54 in the Y direction, in other words, disposed downstream in the Y direction.

The end surface of the pillar portion 56 at the +Z direction is set as an upper surface 56A. The height of the upper surface 56A in the +Z direction is lower than the height of the support face 34 in the +Z direction.

At the first sectioned chamber 54, the pillar portion 58 is disposed at the +Y direction relative to the pillar portion 56 at the other side and upstream of a downstream-side end of the first sectioned chamber 54 in the Y direction. An end surface of the pillar portion 58 at the +Z direction is set as an upper surface 58A. The height of the upper surface 58A in the +Z direction is lower than the height of the support face 34 in the +Z direction. Note that a first suction port 86, which will be described later, is formed in the pillar portion 58, and a second suction port 88, which will be described later, is formed in the pillar portion 56, thereby being formed into a tubular shape. In other words, the pillar portion 58 serves as one example of a wall portion of the first suction port 86. The pillar portion 56 serves as one example of a wall portion of the second suction port 88.

The outer diameter of the pillar portion 56 is smaller than the outer diameter of the pillar portion 58.

The height of the pillar portion 56 in the +Z direction is set so as to be substantially the same as the height of the pillar portion 58 in the +Z direction, and is approximately two-thirds of the depth of the first sectioned chamber 54 in the Z direction, as one example.

The rib 62 is provided at a position differing, in the +Y direction, from that of the first suction port 86 or the second suction port 88, which will be described later, and extends in the +Y direction. Specifically, the rib 62 is formed into a plate shape having a predetermined thickness in the X direction. In addition, the rib 62 is disposed at a more −Y direction than the center of the first bottom surface 55 in the Y direction. Furthermore, the rib 62 includes a mountain portion 63, a flat portion 64, and a mountain portion 65 in this order toward the +Y direction, as one example.

The mountain portion 63 is formed into a trapezoid shape as viewed from the X direction. An upper surface 63A is formed at an end portion of the mountain portion 63 in the +Z direction. The upper surface 63A serves as one example of a top portion, and includes a flat surface extending along the X-Y plane. In addition, the height of the upper surface 63A in the +Z direction is aligned with the height of the support face 34 in the +Z direction, as one example. The upper surface 63A is coupled to the support face 34.

The mountain portion 65 is formed into a trapezoid shape as viewed from the X direction. An upper surface 65A is formed at an end portion of the mountain portion 65 in the +Z direction. The upper surface 65A serves as one example of a top portion, and includes a flat surface extending along the X-Y plane. In addition, the height of the upper surface 65A in the +Z direction is aligned with the height of the support face 34 in the +Z direction, as one example.

The flat portion 64 couples, in the Y direction, the mountain portion 63 and the pillar portion 56 at one side, and also couples, in the Y direction, the pillar portion 56 at one side and the mountain portion 65. In other words, the pillar portion 56 and the rib 62 are integrally formed. An upper surface 64A is formed at an end portion of the flat portion 64 in the +Z direction. The upper surface 64A includes a flat surface extending along the X-Y plane. Furthermore, the height of the upper surface 64A in the +Z direction is the same as the height of the upper surface 56A in the +Z direction.

The rib 66 is disposed so as to be spaced apart from the rib 62 in the Y direction. In addition, the rib 66 is provided at a position differing, in the +Y direction, from the first suction port 86 or the second suction port 88, which will be described later, and extends in the +Y direction. Specifically, the rib 66 is formed into a plate shape having a predetermined thickness in the X direction. Furthermore, the rib 66 is disposed at a more +Y direction than the center of the first bottom surface 55 in the Y direction. In addition, the rib 66 includes a mountain portion 67, a flat portion 68, a mountain portion 69, a flat portion 71 in this order toward the +Y direction, as one example.

The mountain portion 67 is formed into a trapezoid shape as viewed from the X direction. An upper surface 67A is formed at an end portion of the mountain portion 67 in the +Z direction. The upper surface 67A serves as one example of a top portion, and includes a flat surface extending along the X-Y plane. In addition, the height of the upper surface 67A in the +Z direction is aligned with the height of the support face 34 in the +Z direction, as one example. An end portion, at an upstream side in the Y direction, of the mountain portion 67 includes a sloped surface 67B.

The sloped surface 67B rises toward a downstream side in the Y direction. In other words, an end portion of the sloped surface 67B at the +Y direction is disposed at a more +Z direction than an end portion at the −Y direction.

The flat portion 68 couples, in the Y direction, the mountain portion 67 and the pillar portion 56 at the other side, and also couples, in the Y direction, the pillar portion 56 at the other side and the mountain portion 69. An upper surface 68A is formed at an end portion of the flat portion 68 in the +Z direction. The upper surface 68A includes a flat surface extending along the X-Y plane. Furthermore, the height of the upper surface 68A in the +Z direction is the same as the height of the upper surface 56A in the +Z direction.

The mountain portion 69 is formed into a trapezoid shape as viewed from the X direction. An upper surface 69A is formed at an end portion of the mountain portion 69 in the +Z direction. The upper surface 69A serves as one example of a top portion, and includes a flat surface extending along the X-Y plane. In addition, the height of the upper surface 69A in the +Z direction is aligned with the height of the support face 34 in the +Z direction, as one example.

The flat portion 71 couples, in the Y direction, the mountain portion 69 and the pillar portion 58, and also couples, in the Y direction, the pillar portion 58 and the slanting surface 74. An upper surface 71A is formed at an end portion of the flat portion 71 in the +Z direction. The upper surface 71A includes a flat surface extending along the X-Y plane. Furthermore, the height of the upper surface 71A in the +Z direction is the same as the height of the upper surface 58A in the +Z direction.

The second sectioned chamber 76 is formed so as to have a rectangle shape in which the dimension in the Y direction is larger than the dimension in the X direction as viewed from the +Z direction. The size of the second sectioned chamber 76 is substantially the same as the size of the first sectioned chamber 54, as one example. A rounded surface is formed at four corners of the second sectioned chamber 76. In addition, the second sectioned chamber 76 is formed at the support portion 32, and includes a second bottom surface 77 recessed from the support face 34 toward the −Z direction. The second bottom surface 77 serves as one example of a bottom surface. The outer shape of the second bottom surface 77 is substantially similar to the outer shape of the second sectioned chamber 76 as viewed from the +Z direction. Furthermore, the second bottom surface 77 includes two pillar portions 58, and a rib 78, 79, 66 toward the downstream side in the Y direction, as one example.

A slanting surface 81 is formed at an end portion of the second sectioned chamber 76 in the +Y direction. The slanting surface 81 is sloped so that the height in the +Z direction increases toward the +Y direction. In addition, an end portion of the slanting surface 81 in the +Y direction is coupled to the support face 34. The angle of the slanting surface 81 relative to the second bottom surface 77 is approximately 45° as one example. The slanting surface 81 guides, to the support face 34, a tip portion of the roll paper PR in the transport direction.

The ribs 78, 79, 66 are disposed so as to be spaced apart in the Y direction.

The 78 is formed into a trapezoid shape as viewed from the X direction. An upper surface 78A is formed at an end portion of the rib 78 in the +Z direction. The upper surface 78A serves as one example of a top portion, and includes a flat surface extending along the X-Y plane. In addition, the height of the upper surface 78A in the +Z direction is aligned with the height of the support face 34 in the +Z direction, as one example. The upper surface 78A is coupled to the support face 34.

The rib 79 is formed into an isosceles trapezoid as viewed from the X direction. An upper surface 79A is formed at an end portion of the rib 79 in the +Z direction. The upper surface 79A serves as one example of a top portion, and includes a flat surface extending along the X-Y plane. In addition, the height of the upper surface 79A in the +Z direction is aligned with the height of the support face 34 in the +Z direction, as one example. An end portion, at an upstream side in the Y direction, of the rib 79 includes a sloped surface 79B.

The sloped surface 79B rises toward a downstream side in the Y direction. In other words, an end portion of the sloped surface 79B at the +Y direction is disposed at a more +Z direction than an end portion at the −Y direction.

The rib 66 in the second sectioned chamber 76 has a configuration similar to the rib 66 in the first sectioned chamber 54 except that the pillar portion 58 is disposed instead of the pillar portion 56 disposed in the first sectioned chamber 54. In other words, no pillar portion 56 is provided in the second sectioned chamber 76.

The suction portion 84 causes the negative pressure chamber 38 and a space S at the +Z direction that is outside of the support face 34 to communicate with each other. In addition, the suction portion 84 includes a plurality of first suction ports 86 and a plurality of second suction ports 88, which serve as one example of a plurality of suction ports.

The plurality of first suction ports 86 include one first suction port 86 formed in the first sectioned chamber 54, and two first suction ports 86 formed in the second sectioned chamber 76, as one example. The first suction ports 86 are formed at the pillar portion 58. In addition, the first suction ports 86 are through holes extending through the pillar portion 58 in the +Z direction. The shapes of the first suction ports 86 are circular shapes as viewed from the Z direction that is the extending direction. Furthermore, one first opening area of each of the first suction ports 86 as viewed from the Z direction is set as SA (FIG. 3).

The plurality of second suction ports 88 include two second suction ports 88 formed in the first sectioned chamber 54 and no second suction port 88 formed in the second sectioned chamber 76, as one example. At the first sectioned chamber 54, the number of the second suction ports 88 is greater than the number of the first suction ports 86.

The second suction ports 88 are formed at the pillar portion 56. In addition, the second suction ports 88 are through holes extending through the pillar portion 56 in the +Z direction. The shapes of the second suction ports 88 are circular shapes as viewed from the Z direction that is the extending direction. Furthermore, one second opening area of each of the second suction ports 88 as viewed from the Z direction is set as SB (FIG. 3). The second opening area SB is smaller than the first opening area SA.

The second suction port 88 disposed at the most upstream side in the +Y direction in the first sectioned chamber 54 is disposed at a more upstream side in the Y direction than the first suction port 86 disposed at the most upstream side in the +Y direction in the second sectioned chamber 76. In other words, when transportation is performed in a manner such that an end portion of the roll paper PR in the X direction covers the first sectioned chamber 54 and the second sectioned chamber 76 from the +Z direction, the second suction port 88 disposed at the most upstream side in the first sectioned chamber 54 sucks the roll paper PR earlier than the first suction portion 86 disposed at the most upstream side in the second sectioned chamber 76.

At the first sectioned chamber 54, the center of each of the first suction port 86 and the second suction port 88 in the X direction and the center of each of the ribs 62 and 66 in the X direction are disposed side by side in the +Y direction, and are arranged on the same straight line that is not illustrated, as viewed from the +Z direction.

As illustrated in FIG. 5, one emission portion 92 is provided at an end portion of the negative pressure chamber 38 at the +X direction that is one side in the X direction. The emission portion 92 is configured to emit air in the negative pressure chamber 38 to the outside of the negative pressure chamber 38. Note that the emission portion 92 has a configuration in which a fan 93 is rotated by a motor that is not illustrated, as one example. The movable wall 94 is provided at the −X direction side, which is at the other side relative to the emission portion in the X direction in the negative pressure chamber 38.

The movable wall 94 is disposed substantially at the central portion of the negative pressure chamber 38 in the X direction in a manner such that it can rotate around a shaft extending along the Y direction. In addition, the movable wall 94 is configured to rotate to stand upright in the +Z direction, thereby being able to section the negative pressure chamber 38 into a first negative pressure chamber 39 where the emission portion 92 is provided and a second negative pressure chamber 41 wherein no emission portion 92 is provided.

Figure 6:
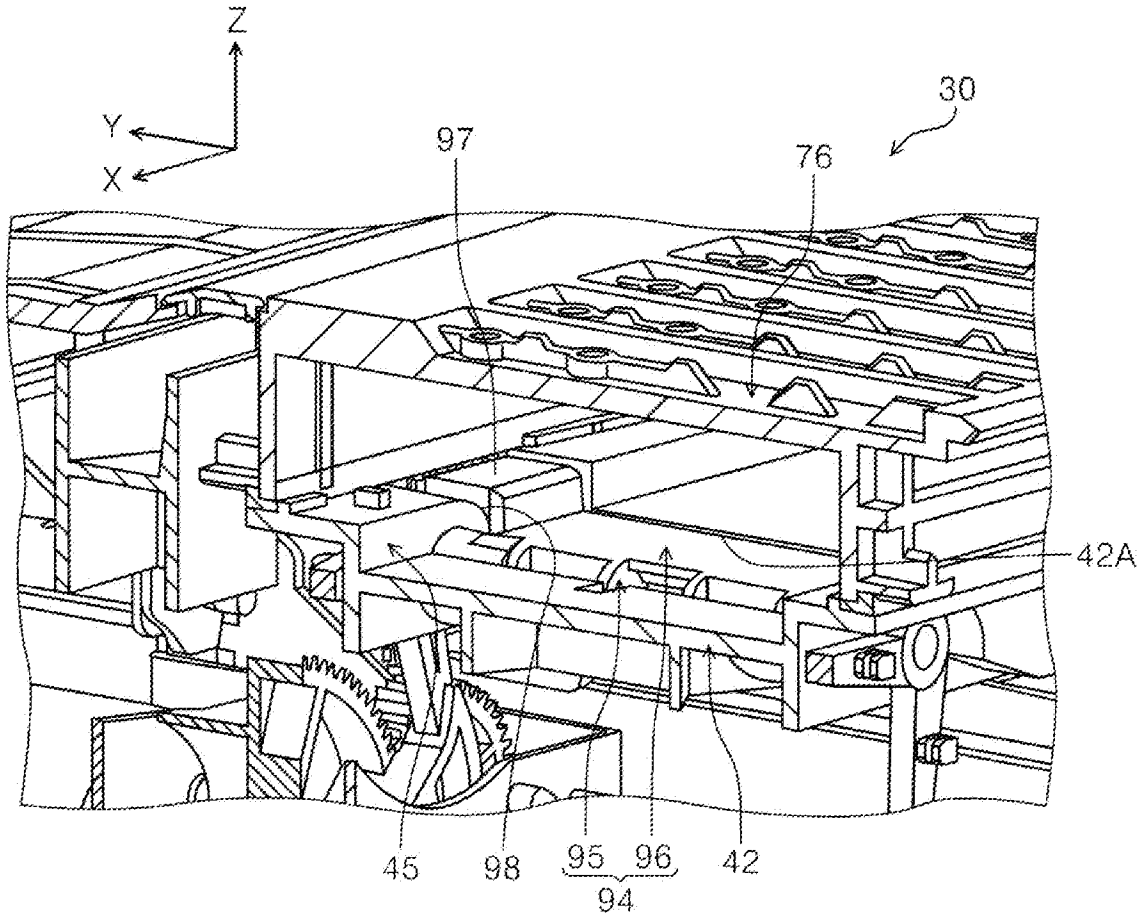
FIG. 6 is a perspective view illustrating the inside of a lower portion of the platen unit of the printer according to the embodiment.

As illustrated in FIG. 6, the bottom wall 42 includes a notch portion 42A formed so as to extend through the bottom wall 42 in the Z direction. The notch portion 42A is formed into a rectangular shape in which the dimension in the Y direction is longer than the dimension in the X direction.

At the time of not sectioning the negative pressure chamber 38, the movable wall 94 is stored in the notch portion 42A. Specifically, the movable wall 94 includes a shaft portion 95 and a vertical wall portion 96, as one example.

The shaft portion 95 is formed into a cylindrical shape with the Y direction being the axial direction, and has both ends in the Y direction supported by a not-illustrated bearing, so that the shaft portion can rotate around the axis extending along the Y direction.

The vertical wall portion 96 is formed integrally with the shaft portion 95, and is also formed into a panel shape. Specifically, the vertical wall portion 96 is formed into a panel shape having a predetermined thickness in the Z direction in a storage state. A projection portion 97 that protrudes from the vertical wall portion 96 in the +Z direction is formed at an end portion of the vertical wall portion 96 in the +Y direction. The projection portion 97 is disposed so as to be aligned with a position of the step portion 45 in the Y direction. A rounded surface 98 is formed at a portion of the bottom wall 42 so as to avoid contact with the vertical wall portion 96 to be rotated.

As illustrated in FIG. 5, the control unit 26 (FIG. 1) performs rotational control to switch the movable wall 94 between a storage position where the movable wall 94 is stored in the notch portion 42A and a section position where the movable wall 94 stands upright along the +Z direction and sections the negative pressure chamber 38.

Specifically, when the width of the roll paper PR in the X direction is equal to or less than the width of the first negative pressure chamber 39 in the X direction, the movable wall 94 is rotated to the section position and stands upright along the +Z direction to section the negative pressure chamber 38 into the first negative pressure chamber 39 and the second negative pressure chamber 41.

In addition, when the width of the roll paper PR in the X direction is larger than the width of the first negative pressure chamber 39 in the X direction, the movable wall 94 is rotated to the storage position, thereby releasing the section between the first negative pressure chamber 39 and the second negative pressure chamber 41.

FIG. 5 illustrates a length L1 corresponding to the width of the first negative pressure chamber 39 in the X direction, a length L2 corresponding to the width of the second negative pressure chamber 41 in the X direction, and the length L3 corresponding to the width of the negative pressure chamber 38 in the X direction. L3=L1+L2 establishes. As one example, when the length of the roll paper PR in the X direction is shorter than the length L1, the movable wall 94 is rotated to the section position, whereby the movable wall 94 sections the negative pressure chamber 38. In addition, when the length of the roll paper PR in the X direction is equal to or longer than the length L1, the movable wall 94 is rotated to the storage position, whereby the section of the negative pressure chamber 38 by the movable wall 94 is released.

Next, operation of the printer 10 according to the embodiment will be described. Note that, as for each configuration of the printer 10, see FIGS. 1 to 6. The individual figure numbers will not be mentioned.

With the printer 10, the air outside of the support portion 32 passes through the first suction port 86 and the second suction port 88 and enters the negative pressure chamber 38. This flow of air causes the roll paper PR to be transported while being pulled toward the support portion 32.

Here, the second suction port 88 in the first sectioned chamber 54 is disposed upstream of the first suction port 86 in the second sectioned chamber 76. Thus, even if the negative pressure in the negative pressure chamber 38 is not enough at an end portion of the support portion 32 in the X direction, suction at the end portion starts earlier than that at the central portion of the roll paper PR in the X direction. This makes it possible to suppress a deficiency of suction at the end portion of the roll paper PR in the X direction.

In addition, the opening area SB of the second suction port 88 disposed upstream of the first suction port 86 is smaller than the opening area SA of the first suction port 86. Thus, the velocity of air flow that enters the second suction port 88 is higher than the velocity of air flow that enters the first suction port 86. This makes it possible to further suppress a deficiency of suction at the end portion of the roll paper PR in the X direction.

With the printer 10, the number of the second suction ports 88 is greater than the number of the first suction ports 86. Since the number of sucked portions at the end portion of the roll paper PR in the X direction is greater than that at the central portion. This makes it possible to suppress lifting of the end portion of the roll paper PR in the X direction at the support portion 32.

With the printer 10, the first suction port 86 and the second suction port 88 are each formed so as to have a tubular shape extending in the +Z direction. This makes the frequency of the generated sound reduced as compared with a configuration in which the first suction port 86 and the second suction port 88 are formed at the support face 34, which makes a so-called whistling effect less likely to occur and makes it possible to suppress noise. Furthermore, since the height of the upper surface 56A, 58A in the +Z direction is lower than the height of the support face 34 in the +Z direction, it is possible to prevent a portion of the roll paper PR that is supported by the support face 34 from being suctioned at the upper surface 56A, 58A of the pillar portion 56, 58.

With the printer 10, the roll paper PR is supported by being brought into contact with the rib 62, 66, 78, 79 before being brought into contact with the first bottom surface 55 or the second bottom surface 77. This makes it possible to prevent a portion of the transported roll paper PR from sagging to the first bottom surface 55 or the second bottom surface 77.

With the printer 10, when a portion of the roll paper PR is sucked with the first suction port 86 or the second suction port 88, the rib 62, 66, 78, 79 supports the roll paper PR upstream or downstream of the first suction port 86 or the second suction port 88 in the +Y direction. Thus, it is possible to prevent a portion of the transported roll paper PR from sagging to the first bottom surface 55 or the second bottom surface 77.

With the printer 10, a portion of the roll paper PR that is opposed to the first sectioned chamber 54 or the second sectioned chamber 76 is supported by the rib 62, 66, 78, 79, as with a portion supported by the support face 34. Thus, it is possible to prevent the roll paper PR from falling into the first sectioned chamber 54 or the second sectioned chamber 76.

With the printer 10, even if a portion of the roll paper PR falls toward the first bottom surface 55 or the second bottom surface 77, the portion of the roll paper PR is brought into contact with the sloped surface 67B, 79B and is guided, so that the position in height of the roll paper PR rises. Thus, it is possible to prevent the portion of the roll paper PR from being caught on the rib 62, 66, 79.

With the printer 10, when external force acts on the pillar portion 56, 58, the rib 62, 66 supports the pillar portion 56, 58, which makes it possible to enhance the strength of the pillar portion 56, 58.

With the printer 10, a portion of the inner wall surface 36 of the negative pressure chamber 38 includes a flat surface. Thus, as compared with a configuration in which a protruding portion is formed at the inner wall surface 36, a pressure loss at the negative pressure chamber 38 reduces. Thus, it is possible to suppress a reduction in suction force at the first suction port 86 or second suction port 88.

In addition, in the support portion 32, an outside portion serving as a portion disposed at an opposite side from the inner wall surface 36 includes a protruding portion that protrudes from the first bottom surface 55 or the second bottom surface 77. Thus, it is possible to easily mold the support portion 32.

With the printer 10, at the reference position E, one end of the roll paper PR in the X direction is pulled toward the support portion 32. Thus, even if the size of the roll paper PR changes, it is possible to cause the support portion 32 to support the one end of the roll paper PR in the X direction.

With the printer 10, the plurality of first sectioned chambers 54 are provided so as to be aligned with the position of an end portion of the roll paper PR at the other side in the X direction. Thus, even if the size of the roll paper PR is changed, it is possible to support both end portions of the roll paper PR in the X direction.

With the printer 10, the emission portion 92 is provided at one side of the negative pressure chamber 38 in the X direction. Thus, when the roll paper PR having a small size is transported in an unbalanced manner toward one side in the X direction, it is possible to efficiently suck the end portion of the roll paper PR having a small size.

With the printer 10, when the width of the roll paper PR in the X direction is equal to or less than the width of the first negative pressure chamber 39 in the X direction, the negative pressure chamber 38 is sectioned by the movable wall 94. This makes it possible to suppress a reduction in pressure in the first negative pressure chamber 39. Thus, it is possible to suppress lifting of the roll paper PR.

On the other hand, when the width of the roll paper PR in the X direction is larger than the width of the first negative pressure chamber 39 in the X direction, the section of the negative pressure chamber 38 by the movable wall 94 is released. This makes it possible to suck a portion of the roll paper PR that corresponds to the second negative pressure chamber 41. Thus, even for the roll paper PR having a large size, it is possible to suppress lifting of an end portion of the roll paper PR in the X direction.

Modification Example

Next, a printer 100 according to a modification example serving as one example of the recording device will be described with reference to the accompanying drawings. Note that the same reference characters are attached to portions common to those in the printer 10, and explanation thereof will not be repeated.

Figure 7:
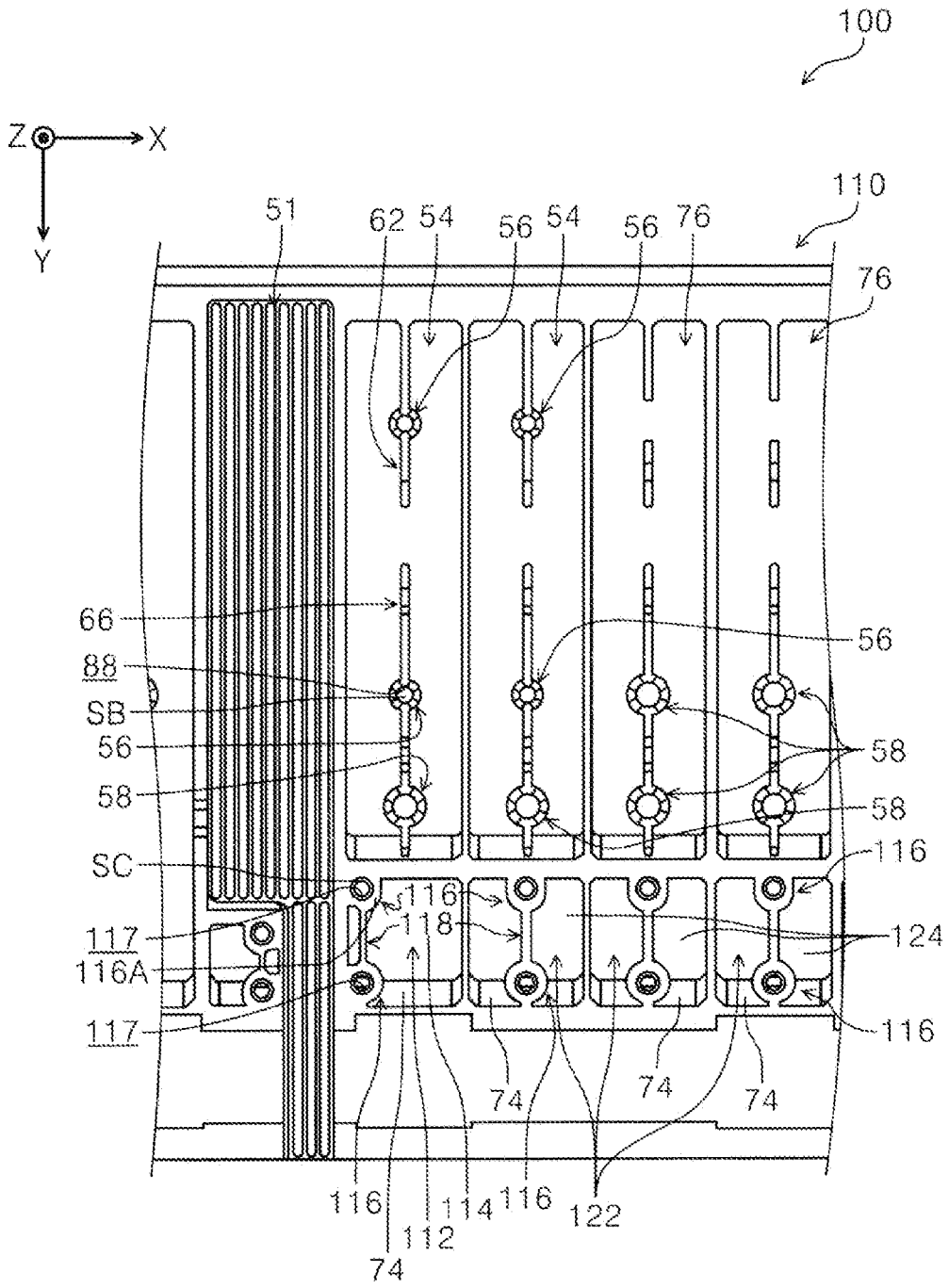
FIG. 7 is an enlarged plan view partially illustrating a portion of a platen unit of a printer according to a modification example.

FIG. 7 illustrates a portion of a platen unit 110 of the printer 100. Note that FIG. 7 illustrates, for example, a position corresponding to the sectioned portion 52B, which is a portion of the platen unit 110 that corresponds to an end portion of the roll paper PR at the other side. As one example, the sectioned portion 52B is configured so as to be symmetric to the sectioned portion 52A with respect to a not-illustrated line extending along the Y direction.

The printer 100 has a configuration in which a platen unit 110 is provided in the printer 10 (FIG. 1), instead of the platen unit 30. In other words, the printer 100 has a configuration similar to the configuration of the printer 10, except for the configuration of the platen unit 110.

The platen unit 110 differs in that a third sectioned chamber 112 and a fourth sectioned chamber 122 are further provided in the platen unit 30 (FIG. 1). Other configurations are similar to those of the platen unit 30.

The third sectioned chamber 112 is disposed downstream in the Y direction of the first sectioned chamber 54 disposed adjacent to the recessed portion 51, as one example. The length of the third sectioned chamber 112 in the Y direction is shorter than the length of the first sectioned chamber 54 in the Y direction. Furthermore, the third sectioned chamber 112 includes a bottom surface 114 recessed from the support face 34 toward the −Z direction. The slanting surface 74 is formed at an end portion of the third sectioned chamber 112 in the +Y direction.

The bottom surface 114 includes two pillar portions 116 and one rib 118, as one example.

The two pillar portions 116 are formed into a cylindrical shape that stands upright from the bottom surface 114 in the +Z direction. The two pillar portions 116 are disposed at both ends of the third sectioned chamber 112 in the Y direction. In addition, the two pillar portions 116 are disposed so as to be shifted in the −X direction relative to a not-illustrated extended line obtained by extending the rib 66 in the Y direction.

An end portion of the pillar portion 116 in the +Z direction is set as an upper surface 116A. The height of the upper surface 116A in the +Z direction is equal to the height of the support face 34 in the +Z direction. A third suction port 117 extending through the pillar portion 116 in the Z direction is formed at the pillar portion 116.

An opening area SC of the third suction port 117 is approximately the same as the opening area SB of the second suction port 88 as viewed from the Z direction, as one example.

The rib 118 is formed into a panel shape having a predetermined thickness in the X direction, and extends along the Y direction. In addition, the rib 118 couples two pillar portions 116 in the Y direction. Furthermore, the rib 118 is disposed so as to be shifted in the −X direction relative to the above-described extended line of the rib 66.

In this manner, the two pillar portions 116 and the rib 118 are disposed in an unbalanced manner toward the −X direction relative to the center of the third sectioned chamber 112. In other words, in the third sectioned chamber 112, the two pillar portions 116 and the rib 118 are disposed closer to the recessed portion 51 or to an end portion of the roll paper PR in the X direction.

The fourth sectioned chamber 122 is disposed downstream in the Y direction of the second sectioned chamber 76 and a first sectioned chamber 54 that is not adjacent to the recessed portion 51, as one example. The length of the fourth sectioned chamber 122 in the Y direction is substantially equal to the length of the third sectioned chamber 112 in the Y direction. In addition, the fourth sectioned chamber 122 includes a bottom surface 124 recessed from the support face 34 toward the −Z direction. The slanting surface 74 is formed at an end portion of the fourth sectioned chamber 122 in the +Y direction.

The bottom surface 124 includes one rib 118 and two pillar portions 116 including a third suction port 117, as one example. Note that, in the fourth sectioned chamber 122, the two pillar portions 116 and the rib 118 are disposed on the above-described extended line of the rib 62. In other words, the arrangement of the two pillar portions 116 and the rib 118 in the X direction differs between the third sectioned chamber 112 and the fourth sectioned chamber 122.

With the printer 100, the position of the third suction port 117 in the third sectioned chamber 112 is disposed closer to the position of an end portion of the roll paper PR in the X direction. This makes it possible to easily pull, toward the support portion 32, the end portion of the roll paper PR in the X direction that has passed the first sectioned chamber 54.

The printer 10, 100 according to the embodiment or the modification example of the present disclosure basically has the configuration described above. However, it is needless to say that it is possible to make partial modification to or omission from the configuration or the like without departing from the main point of the disclosure of the present application.

In the printer 10, 100, the number of the second suction ports 88 may be equal to or less than the number of the first suction ports 86. At each of the first bottom surface 55 and the second bottom surface 77, the total number of the pillar portions 56 and the pillar portions 58 may be one or may be four or more. The height of the upper surface 56A, 58A may be equal to the height of the support face 34. The number of ribs formed at each of the first bottom surface 55 and the second bottom surface 77 may be one or may be four or more. In addition, a plurality of the ribs may be arranged side by side in the X direction. Alternatively, no rib may be formed at the first bottom surface 55 or the second bottom surface 77.

The center, in the X direction, of the first suction port 86 or the second suction port 88 and the center of the rib 62, 66, 78, 79 in the X direction may be disposed so as to be shifted from each other in the X direction. The height of the top portion of the rib 62, 66, 78, 79 may be lower than the height of the support face 34. The rib 66 may not include the sloped surface 67B. The rib 79 may not include the sloped surface 79B.

The pillar portion 56, 58 and the rib 62, 66 may be formed separately.

A portion protruding toward the inside may be formed at a portion of the inner wall surface 36.

The first sectioned chamber 54 may not be adjacent to the recessed portion 51 in the X direction. In addition, the first sectioned chamber 54 may be disposed so as to be shifted from the reference position E in the X direction. The number of the first sectioned chambers 54 disposed at another side relative to the reference position E may be one.

The emission portion 92 may be disposed at a side wall of the negative pressure chamber 38.

If the suction state of the roll paper PR can be secured, the movable wall 94 may be disposed at the storage position even for the roll paper PR having a small size. Furthermore, the movable wall 94 is not limited to the wall that can rotate, and may be an element that slides in the Z direction.

The recording unit 18 may be a serial-type recording head or a line head. The arrangement type of the sheet P is not limited to the side registration system in which the sheet P is disposed in an unbalance manner toward the +X direction or the −X direction. It may be possible to employ a center registration system in which the center of the device in the X direction is aligned with the center of the sheet P.

What is claimed is:

1. A recording device comprising:

a recording unit configure to perform recording on a recording medium transported in a transport direction;

a support portion disposed facing the recording unit and including a support face configured to support the recording medium;

a negative pressure chamber disposed at an opposite side of the support portion from a side of the recording unit;

a plurality of sectioned chambers formed at the support portion and including a bottom surface recessed from the support face, the sectioned chambers being disposed in a width direction intersecting the transport direction; and a plurality of suction ports formed inside each of the plurality of sectioned chambers and configured to cause the negative pressure chamber and a space outside of the support face to communicate with each other, wherein the plurality of sectioned chambers include:

at least two first sectioned chambers, each of which is configured to face the recording medium at a position inside a respective end portion of the recording medium in the width direction and closest to the respective end portion; and at least one second sectioned chamber disposed inside the least two first sectioned chambers in the width direction, the plurality of suction ports include:

at least one first suction port; and at least one second suction port having a second opening area smaller than a first opening area of the first suction port, and a second suction port disposed most upstream in the transport direction in the first sectioned chamber is disposed upstream, in the transport direction, of a first suction port disposed most upstream in the transport direction in the second sectioned chamber.

2. The recording device according to claim 1, wherein the number of the second suction port is greater than the number of the first suction port.

3. The recording device according to claim 1, wherein the bottom surface includes at least one pillar portion that stands upright from the bottom surface, a height of an upper surface of the at least one pillar potion in an upright direction is lower than a height of the support face in the upright direction, and the plurality of suction ports are through holes that extend through the at least one pillar portion in the upright direction.

4. The recording device according to claim 1, wherein the bottom surface includes at least one rib extending in the transport direction and provided at a position differing from the suction ports in the transport direction.

5. The recording device according to claim 4, wherein centers of the suction ports in the width direction and a center of the rib in the width direction are disposed side by side in the transport direction.

6. The recording device according to claim 4, wherein a height of at least a portion of a top portion of the rib is aligned with the height of the support face.

7. The recording device according to claim 4, wherein an upstream end portion, in the transport direction, of the rib includes a sloped surface that rises toward downstream.

8. The recording device according to claim 4, wherein wall portions of the suction ports and the rib are integrally formed.

9. The recording device according to claim 8, wherein the support portion includes an inner wall surface that constitutes a portion of a wall surface of the negative pressure chamber, and in the support portion, the support face, the wall portions of the suction ports, and the inner wall surface corresponding to a position where the rib is formed are flat surfaces.

10. The recording device according to claim 1, wherein the recording unit discharges a droplet on the recording medium to perform recording, a droplet receiving portion configured to receive the droplet when borderless recording is performed on the recording medium is provided at a portion of the support face that corresponds to an end portion of the recording medium in the width direction, and the first sectioned chamber is adjacent to the droplet receiving portion in the width direction.

11. The recording device according to claim 10, wherein, in the support face, the droplet receiving portion is provided at a reference position where one end of the recording medium in the width direction is disposed.

12. The recording device according to claim 11, wherein the recording unit is configured to perform recording on the recording medium having a plurality of sizes with different widths in the width direction, and a plurality of the droplet receiving portions are provided at positions, other than the reference position, corresponding to positions of an end portion of the recording medium at another side in the width direction.

13. The recording device according to claim 1, wherein one emission portion configured to emit air in the negative pressure chamber is provided at an end portion of the negative pressure chamber at one side in the width direction.

14. The recording device according claim 13, wherein a movable wall is provided closer to an opposite side of the negative pressure chamber, in the width direction, from the emission portion, the movable wall being configured to section the negative pressure chamber into a first negative pressure chamber where the emission portion is provided and a second negative pressure chamber where the emission portion is not provided, the movable wall sections the negative pressure chamber into the first negative pressure chamber and the second negative pressure chamber when the width of the recording medium in the width direction is equal to or less than the width of the first negative pressure chamber in the width direction, and the movable wall does not section the negative pressure chamber into the first negative pressure chamber and the second negative pressure chamber when the width of the recording medium in the width direction is larger than the width of the first negative pressure chamber in the width direction.

* * * * *